US009463915B2

(12) United States Patent
McDonald et al.

(10) Patent No.: US 9,463,915 B2
(45) **Date of Patent: *Oct. 11, 2016**

(54) COMPRESSIBLE PACKAGING ASSEMBLY

(71) Applicants: John McDonald, Fallbrook, CA (US); Frank Comerford, Laguna Niguel, CA (US); Myles Comerford, Rancho Santa Fe, CA (US)

(72) Inventors: John McDonald, Fallbrook, CA (US); Frank Comerford, Laguna Niguel, CA (US); Myles Comerford, Rancho Santa Fe, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/065,304

(22) Filed: Oct. 28, 2013

(65) Prior Publication Data

US 2015/0114875 A1 Apr. 30, 2015

(51) Int. Cl.

| | |
|---|---|
| ***B65D 81/107*** | (2006.01) |
| ***B65D 5/02*** | (2006.01) |
| ***B65D 5/20*** | (2006.01) |
| ***B65D 5/50*** | (2006.01) |

(52) U.S. Cl.

CPC ..... *B65D 81/1075* (2013.01); *B65D 5/02* (2013.01); *B65D 5/20* (2013.01); *B65D 5/509* (2013.01); *B65D 5/5028* (2013.01)

(58) Field of Classification Search

CPC ..... B65D 1/225; B65D 1/22; B65D 81/05–81/058; B65D 81/107; B65D 81/1075; B31B 7/00; B31B 17/00; B31B 1/60

USPC ..... 206/591, 592, 521, 523, 736; 220/62; 229/117.01, 108, 108.1

See application file for complete search history.

(56) References Cited

U.S. PATENT DOCUMENTS

| | | | |
|---|---|---|---|
| 1,821,692 | A | 9/1931 | Copeland |
| 2,012,131 | A | 8/1935 | Kondolf |
| 2,161,128 | A | 6/1939 | Boyle |
| 2,746,665 | A | 4/1950 | Wiggins |
| 2,617,573 | A | 11/1952 | Nahoom |
| 2,723,796 | A | 11/1955 | Malmgren |
| 2,797,855 | A | 7/1957 | Moore |
| 2,807,265 | A | 9/1957 | Oliva et al. |
| 2,948,455 | A | 8/1960 | Frankenstein |
| 2,956,672 | A | 10/1960 | Kirkpatrick |
| 3,047,137 | A | 7/1962 | Kindseth |

(Continued)

FOREIGN PATENT DOCUMENTS

| | | |
|---|---|---|
| DE | 299 21 203 | 2/2000 |
| DE | 101 05 487 | 8/2002 |

(Continued)

OTHER PUBLICATIONS

GXT Green, "ECO-R$^3$SP Reusable Suspension Packaging", http://web.archive.org/web/20160425174511/http://www.gxtgreen.com/r3sp as archived Apr. 25, 2016 in 3 pages.

(Continued)

*Primary Examiner* — Steven A. Reynolds
*Assistant Examiner* — Javier A Pagan
(74) *Attorney, Agent, or Firm* — Knobbe, Martens, Olson & Bear, LLP

(57) ABSTRACT

A packaging container can be configured to include cushioning material and to be foldable between an expanded state in which the container can be used to ship an article and a compressed state in which the container occupies a smaller volumetric space without the article being contained therein. This can reduce shipping costs associated with transporting the empty container.

17 Claims, 8 Drawing Sheets

(56) References Cited

U.S. PATENT DOCUMENTS 3,089,631 A 5/1963 Tyrseck et al.
3,285,493 A 11/1966 Coe et al.
3,326,410 A 6/1967 Asenbauer
3,345,643 A 10/1967 Bradley
3,434,650 A 3/1969 Goings
3,695,421 A 10/1972 Wood
3,706,174 A 12/1972 Young et al.
3,853,220 A 12/1974 Luray
3,854,650 A 12/1974 Hanaue
3,899,119 A 8/1975 Roccaforte
3,905,474 A 9/1975 Haibara
3,917,108 A 11/1975 Thurman
3,923,578 A 12/1975 Hair
3,994,433 A 11/1976 Jenkins et al.
4,034,908 A 7/1977 Forbes et al.
4,077,518 A 3/1978 Kisslinger et al.
4,155,453 A 5/1979 Ono
4,335,817 A 6/1982 Bahr
4,606,460 A 8/1986 Luray
4,698,246 A 10/1987 Gibbons et al.
4,801,774 A 1/1989 Hart
4,806,398 A 2/1989 Martin, Jr.
4,830,272 A 5/1989 Wear et al.
4,852,743 A 8/1989 Ridgeway
4,886,299 A 12/1989 Ducorday
4,923,065 A 5/1990 Ridgeway
5,024,536 A 6/1991 Hill
5,029,900 A 7/1991 Axelrod
5,046,659 A 9/1991 Warburton
5,056,665 A 10/1991 Boecker et al.
5,071,009 A 12/1991 Ridgeway
5,076,436 A 12/1991 Bortolani et al.
5,080,497 A 1/1992 Peppiatt
5,183,159 A 2/1993 Hojnacki et al.
5,207,327 A 5/1993 Brondos
5,211,290 A 5/1993 Janus et al.
5,217,159 A 6/1993 Calvert et al.
5,218,510 A 6/1993 Bradford
5,223,121 A 6/1993 Dickie et al.
5,226,542 A 7/1993 Boecker et al.
5,226,734 A 7/1993 Scott et al.
5,251,760 A 10/1993 Smith et al.
5,301,872 A 4/1994 Tusing et al.
5,318,219 A 6/1994 Smith
5,322,168 A 6/1994 Kataoka
5,323,896 A 6/1994 Jones
5,356,007 A 10/1994 Feldt
5,372,257 A 12/1994 Beauchamp et al.
5,388,701 A 2/1995 Ridgeway
5,394,985 A 3/1995 Van Hest
5,405,000 A 4/1995 Hagedon et al.
5,467,916 A 11/1995 Beales
5,474,230 A 12/1995 Yotukura
5,492,223 A 2/1996 Boardman et al.
5,524,789 A 6/1996 Jackman
5,562,228 A * 10/1996 Ericson ..... A45C 7/0077 206/545
5,579,917 A 12/1996 Lofgren et al.
5,641,068 A 6/1997 Warner
5,669,506 A 9/1997 Lofgren et al.
5,676,245 A 10/1997 Jones
5,678,695 A 10/1997 Ridgeway
5,694,744 A 12/1997 Jones
5,722,541 A 3/1998 Lofgren et al.
5,731,021 A 3/1998 Spector
5,738,218 A 4/1998 Gonzales
5,762,200 A 6/1998 Goudreau
5,769,235 A 6/1998 Keach et al.
5,788,081 A 8/1998 Bates et al.
5,797,493 A 8/1998 Watson
5,803,267 A 9/1998 Tu et al.
5,823,348 A 10/1998 Phillips et al.
5,823,352 A 10/1998 Mena et al.
5,893,462 A 4/1999 Ridgeway
5,894,932 A 4/1999 Harding et al.
5,934,473 A 8/1999 Belshé
5,934,474 A 8/1999 Renninger et al.
5,954,203 A 9/1999 Marconl
5,967,327 A 10/1999 Jones
RE36,412 E 11/1999 Jones
5,975,307 A 11/1999 Harding et al.
5,988,387 A 11/1999 Staal et al.
6,006,917 A 12/1999 Loeffler
6,010,003 A 1/2000 Wilkinson
6,047,831 A 4/2000 Jones
6,073,761 A 6/2000 Jones
6,079,563 A 6/2000 Katchmazenski
6,116,501 A 9/2000 Hupp
6,119,863 A 9/2000 Lofgren et al.
6,119,929 A 9/2000 Rose
6,148,590 A 11/2000 Ridgeway et al.
6,148,591 A 11/2000 Ridgeway et al.
6,158,589 A 12/2000 Smith et al.
6,164,821 A 12/2000 Randall
6,206,194 B1 3/2001 Beneroff et al.
6,223,901 B1 5/2001 Lofgren et al.
6,289,655 B1 9/2001 Ridgeway et al.
6,302,274 B1 10/2001 Ridgeway
6,308,828 B1 10/2001 Jones
6,311,843 B1 11/2001 Smith et al.
6,311,844 B1 11/2001 Ridgeway et al.
6,325,239 B2 12/2001 Randall et al.
6,364,199 B1 4/2002 Rose
6,398,412 B2 6/2002 Wedi et al.
6,467,624 B1 10/2002 Lofgren et al.
6,488,153 B1 12/2002 Morris
6,675,973 B1 1/2004 McDonald et al.
6,676,009 B1 1/2004 Rose
6,676,293 B2 1/2004 Ferris
6,837,420 B2 * 1/2005 Westerman et al. ..... 229/117.15
6,899,229 B2 5/2005 Dennison et al.
6,913,147 B2 7/2005 Mueller et al.
6,920,981 B2 7/2005 Lofgren et al.
6,942,101 B2 9/2005 Lofgren et al.
7,000,774 B2 2/2006 Bryant
7,086,534 B2 8/2006 Roesel et al.
7,096,647 B2 8/2006 De Barbuat et al.
7,114,618 B2 10/2006 Arnold
7,124,555 B2 10/2006 Torre
7,150,356 B2 12/2006 Lofgren et al.
7,192,640 B2 3/2007 Holbert et al.
7,255,261 B2 8/2007 Mesly
7,290,662 B2 11/2007 Lofgren et al.
7,293,695 B2 11/2007 Stier
7,296,681 B2 11/2007 McDonald et al.
7,299,926 B2 11/2007 Russel et al.
7,398,884 B2 7/2008 Stegner et al.
7,452,316 B2 * 11/2008 Cals et al. ..... 493/95
7,478,514 B2 1/2009 Wenz
7,654,391 B2 2/2010 Langer et al.
7,669,716 B2 3/2010 Lightner et al.
7,673,751 B2 3/2010 Keiger
7,694,496 B2 4/2010 Keiger et al.
7,731,032 B2 6/2010 McDonald et al.
7,743,924 B2 6/2010 McDonald et al.
7,753,209 B2 7/2010 McDonald et al.
7,770,734 B2 8/2010 Saitou et al.
7,775,367 B2 8/2010 McDonald et al.
7,784,614 B2 8/2010 Yen
7,882,956 B2 2/2011 McDonald et al.
7,918,339 B2 4/2011 Kashiwabara
7,931,151 B2 4/2011 McDonald et al.
8,016,112 B2 9/2011 Kasiwabara
8,028,838 B2 10/2011 McDonald et al.
8,123,039 B2 2/2012 McDonald et al.
8,127,928 B2 3/2012 Stack, Jr. et al.
8,177,067 B2 5/2012 McDonald et al.
8,181,787 B2 5/2012 Klos
8,215,488 B2 7/2012 Klos
8,235,216 B2 8/2012 McDonald et al.
8,316,760 B2 11/2012 Berthault
8,408,412 B2 4/2013 Hong
8,499,937 B2 8/2013 McDonald et al.
8,505,731 B2 8/2013 McDonald et al.

(56) References Cited

U.S. PATENT DOCUMENTS

| | | | |
|---|---|---|---|
| 8,579,184 | B2 | 11/2013 | Pettersson et al. |
| 8,627,958 | B2 | 1/2014 | McDonald et al. |
| 8,714,357 | B2 | 5/2014 | Ridgeway |
| 8,727,123 | B1 | 5/2014 | Roberts |
| 8,752,707 | B2 | 6/2014 | McDonald et al. |
| 8,783,459 | B1 | 7/2014 | Marcinkowski |
| 9,067,722 | B2 | 6/2015 | McDonald et al. |
| 9,126,743 | B2 | 9/2015 | Roberts |
| 9,150,343 | B2 | 10/2015 | Roberts |
| 9,199,761 | B2 | 12/2015 | McDonald et al. |
| 2001/0047950 | A1 | 12/2001 | Beneroff et al. |
| 2003/0034273 | A1 | 2/2003 | Auclair |
| 2003/0209463 | A1 | 11/2003 | Halpin |
| 2003/0213717 | A1 | 11/2003 | Kanai |
| 2003/0234207 | A1 | 12/2003 | Koike |
| 2004/0086692 | A1 | 5/2004 | Clark |
| 2004/0108239 | A1 | 6/2004 | McDonald et al. |
| 2004/0129601 | A1 | 7/2004 | Lofgren et al. |
| 2004/0140243 | A1 | 7/2004 | Roesel et al. |
| 2004/0178113 | A1 | 9/2004 | Lofgren et al. |
| 2005/0011807 | A1 | 1/2005 | Dennison et al. |
| 2005/0121354 | A1 | 6/2005 | Gillis et al. |
| 2005/0252825 | A1 | 11/2005 | Lofgren et al. |
| 2005/0286816 | A1 | 12/2005 | Laske |
| 2006/0032777 | A1 | 2/2006 | Russell et al. |
| 2006/0042995 | A1 | 3/2006 | McGrath et al. |
| 2006/0102515 | A1 | 5/2006 | McDonald et al. |
| 2006/0213803 | A1 | 9/2006 | Saitou et al. |
| 2006/0285777 | A1 | 12/2006 | Howell et al. |
| 2007/0237863 | A1 | 10/2007 | Langen |
| 2007/0284281 | A1 | 12/2007 | Shimazu et al. |
| 2008/0110788 | A1 | 5/2008 | Keiger |
| 2008/0110794 | A1 | 5/2008 | Anderson et al. |
| 2008/0223750 | A1 | 9/2008 | McDonald et al. |
| 2008/0230592 | A1 | 9/2008 | Cavell et al. |
| 2009/0188833 | A1 | 7/2009 | Klos |
| 2009/0242448 | A1 | 10/2009 | Keiger |
| 2009/0308880 | A1 | 12/2009 | Sims et al. |
| 2010/0001056 | A1* | 1/2010 | Chandaria ..... 229/198.2 |
| 2010/0192519 | A1 | 8/2010 | Keiger |
| 2010/0200453 | A1 | 8/2010 | Keiger |
| 2010/0276330 | A1 | 11/2010 | McDonald et al. |
| 2011/0068042 | A1 | 3/2011 | Palumbo |
| 2011/0095076 | A1 | 4/2011 | Knighton |
| 2011/0108448 | A1 | 5/2011 | Goodrich |
| 2011/0139673 | A1 | 6/2011 | Klos |
| 2012/0045558 | A1 | 2/2012 | Fanfani et al. |
| 2012/0125807 | A1 | 5/2012 | Jones et al. |
| 2012/0181213 | A1 | 7/2012 | Klos |
| 2012/0193262 | A1 | 8/2012 | Takahashi |
| 2012/0193405 | A1 | 8/2012 | McDonald et al. |
| 2012/0211388 | A1 | 8/2012 | Orgeldinger |
| 2012/0234723 | A1 | 9/2012 | Klos |
| 2013/0043298 | A1 | 2/2013 | Takahashi |
| 2013/0048533 | A1 | 2/2013 | McDonald et al. |
| 2013/0091807 | A1 | 4/2013 | McDonald et al. |
| 2013/0137562 | A1 | 5/2013 | Penttinen et al. |
| 2013/0233752 | A1 | 9/2013 | Hammerschmidt |
| 2013/0284733 | A1 | 10/2013 | Samprathi |
| 2014/0183097 | A1 | 7/2014 | Leroy et al. |
| 2014/0284248 | A1 | 9/2014 | Klos |
| 2014/0360913 | A1 | 12/2014 | McDonald et al. |
| 2015/0114876 | A1 | 4/2015 | McDonald et al. |
| 2015/0239635 | A1 | 8/2015 | McDonald et al. |
| 2015/0266639 | A1 | 9/2015 | McDonald et al. |
| 2015/0266642 | A1 | 9/2015 | McDonald et al. |
| 2015/0314936 | A1 | 11/2015 | Stack, Jr. et al. |
| 2016/0016685 | A1 | 1/2016 | Bauernfeind |

FOREIGN PATENT DOCUMENTS

| | | |
|---|---|---|
| DE | 202 17 626 | 1/2003 |
| EP | 0 980 334 | 8/2002 |
| EP | 1 431 196 | 6/2004 |
| EP | 1 561 693 | 8/2005 |
| EP | 1 657 166 | 5/2006 |
| EP | 1 657 167 | 5/2006 |
| EP | 2 546 170 | 1/2013 |
| JP | 05-305956 | 11/1993 |
| JP | 2004-231228 | 8/2004 |
| JP | 2005-146112 | 6/2005 |
| SU | 827346 A1 | 5/1981 |
| WO | WO 00/53499 | 9/2000 |
| WO | WO 00/64772 | 11/2000 |
| WO | WO 2006/081360 | 8/2006 |
| WO | WO 2007/127243 | 11/2007 |
| WO | WO 2008/086532 | 6/2008 |
| WO | WO 2008/115829 | 9/2008 |
| WO | WO 2013/150312 | 10/2013 |
| WO | WO 2014/043569 | 3/2014 |
| WO | WO 2015/143175 | 9/2015 |

OTHER PUBLICATIONS

High-Tech Information Service Co., "Introduction of Packing Material 'High-Tech Cushion'", http://www.his-net.jp/ as printed Apr. 26, 2016 in 2 pages.

HiTec Cushion, http://hitec-cushion.his-net.jp/ as printed Apr. 26, 2016 in 2 pages.

HiTec Cushion, http://web.archive.org/web/20140301081401/http:/hitec-cushion.his-net.jp/ as archived Mar. 1, 2014 in 2 pages, [not including any discussion of heat sealing as a method of construction for packaging inserts].

HiTec Cushion, "Base", https://web.archive.org/web/20130926211952/http:/hitec-cushion.his-net.jp/base/index.html as archived Sep. 26, 2013 in 1 page, [not including any discussion of heat sealing as a method of construction for packaging inserts; dated Sep. 26, 2013].

HiTec Cushion, "Eco", http://hitec-cushion.his-net.jp/base/eco.html as printed Apr. 26, 2016 in 1 page, [including discussion of heat sealing as a method of construction for packaging inserts; accesssed Apr. 2016].

HiTec Cushion, "Eco", https://web.archive.org/web/20090714064204/http:/hitec-cushion.his-net.jp/base/eco.html as archived Jul. 14, 2009 in 1 page, [not including any discussion of heat sealing as a method of construction for packaging inserts; dated Jul. 14, 2009].

HiTec Cushion, "Product List", http://hitec-cushion.his-net.jp/main/itiranu.html as printed Apr. 26, 2016 in 6 pages.

HiTec Cushion, "Introduction of Packing Material", http://hitec-cushion.his-net.jp/main/standard.html as printed Apr. 26, 2016 in 3 pages.

Japan Packaging Institute (JPI), "Accessories for Packing, 'High-Tech Cushion'", http://www.jpi.or.jp/saiji/jpc/2007/japanese/026.htm as printed Apr. 26, 2016 in 1 page, [not including any discussion of heat sealing as a method of construction for packaging inserts; dated 2007].

Resende, Patricia, "Startup to Bring Photo-Degradable Bags to Grocery Chains", Apr. 12, 2012, pp. 2, http://www.bizjournals.com/boston/blog/mass-high-tech/2012/04/startup-to-bring-photo-degradable-bags.html, [not including any discussion of heat sealing as a method of construction for R3SP packaging insert; dated Apr. 2012].

* cited by examiner

COMPRESSIBLE PACKAGING ASSEMBLY

BACKGROUND OF THE INVENTIONS

1. Field of the Inventions

The present inventions are directed to compressible packaging assemblies, for example, corrugated cardboard assemblies having compressible cushioning material enclosed therein.

2. Description of the Related Art

A variety of companies ship fully erected ("set up") but empty shipping containers, which may include cushioning material, to customers or end users for returning equipment. For examples, some companies use this technique for facilitating the return of delicate components, such as cable boxes, laptop computers, cell phones, etc. The customer receives the empty box in the mail, inserts the device to return to the company then ships the box to the appropriate location.

While the service does provide convenience to the end user, there can be large costs associated with shipping an empty box. This is because shipping costs are not solely determined by weight. Rather, shipping companies often use a pricing technique known as "dimensional weight" costing. As an example, consider a box having the dimensions of 19"×16"×5.5". Under a "dimensional weight" costing schedule, the above-noted box would be considered to encompass a volume of 1,672 cubic inches. The volume of the box is then divided by a constant, such as 194 cubic inches per pound, resulting in a "dimensional weight" of 8.62 pounds. This fictional weight of the box is then used for pricing the shipping cost based on the standard weight-dependent shipping cost schedules.

SUMMARY OF THE INVENTIONS

An aspect of at least one of the inventions disclosed herein includes the realization that the costs associated with shipping fully erected, empty containers, which is the practice of some companies in the industry, can be significantly reduced by providing a packaging solution that presents an easy-to-use assembly that includes a proper outer shipping container and includes inner cushioning material, but which can be compressed. As such, the shipping solution can be compressed to a reduced volume and sent to a customer with a lower dimensional weight and thus a lower shipping cost. The customer can then open and expand the compressed container, insert the article to be shipped, then close and ship the container in its expanded but closed state. As such, shipping cost penalties associated with shipping a larger empty container can be avoided.

For example, in some of the embodiments disclosed herein, a cushioned shipping container assembly that is configured to provide a 19"×16"×5.5" shipping container can be folded and compressed to a size of 19"×16"×1", when empty. As such, under the dimensional weight costing scenario noted above, the compressed box would occupy a volume of approximately 304 cubic inches. Under the above-noted formula, the volume of 304 inches would be divided by 194 cubic inches per pound, resulting in a fictional weight of 1.57 pounds, which would then be used to calculate the shipping cost of the compressed container under standard weight-based shipping cost schedules. In this example, the compressed box can be shipped at one-fifth of the shipping cost of the empty box noted in the Background section of the present application.

Thus, in accordance with some embodiments, a shipping container assembly comprises an outer shell assembly configured to define a complete outer shell appropriate for shipping and compressible cushion material. The assembly is configured to be folded into a compressed state in which the cushion materials are compressed from their free shape into a compressed state such that the assembly occupies a first volume of space. The assembly is also configured to be foldable to a second state occupying a second volume larger than the first volume, and in which the outer surface of the container is sufficiently continuous to be appropriate for shipping.

Accordingly, as noted above, by providing a shipping solution that can be folded into a compressed state and a second enlarged state, the assembly can be shipped at a lower cost because it occupies a smaller volume when empty and in the compressed state. Additionally, the assembly can be conveniently expanded into a shipping container for containing an article to be shipped. Thus, such a device can save shipping costs.

In accordance with other embodiments, a shipping container can be configured for containing and protecting an article during transportation. The shipping container can comprise an outer container assembly comprising one or more pieces of planar substrate material defining at least a bottom wall and a plurality of side walls connected to the bottom wall. The one or more pieces of planar substrate material can be foldable between a first collapsed configuration in which the bottom and plurality of walls at least partially surround a first volume, and a second deployed configuration in which the bottom and the plurality of side walls at least partially surround a second volume that is larger than the first volumes. At least a first compressible cushion member comprising a compressible material can also be included. The first compressible cushion member can be disposed within the outer container assembly. The first compressible cushion member can also have a size such that when the first compressible cushion member is pressed into a compressed state when the one or more pieces of planar substrate material are in the first collapsed configuration, and wherein the first compressible cushion member is expanded to an expanded state in which the first compressible cushion member is larger than when in the compressed state.

DETAILED DESCRIPTION OF THE PREFERRED EMBODIMENT

An improved packaging assembly is disclosed herein. The packaging assembly, in some embodiments, includes frame portions having compressible cushion material attached hereto and are configured to be foldable into compressed states.

In the following detailed description, terms of orientation such as "upper," "lower," "longitudinal," "horizontal," "vertical," "lateral," "midpoint," and "end" are used herein to simplify the description in the context of the illustrated embodiments. Because other orientations are possible, however, the present inventions should not be limited to the illustrated orientations. Those skilled in the art will appreciate that other orientations of various components described herein are possible.

Figure 1:
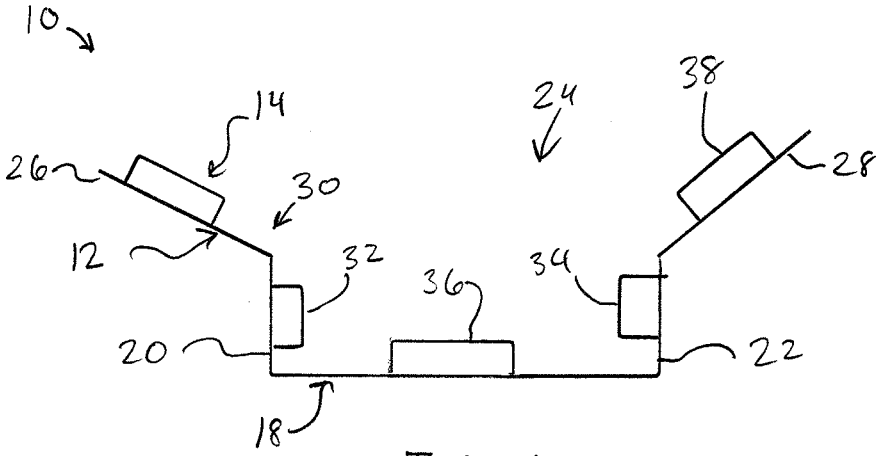
FIG. 1 is a schematic side elevational view of a shipping container having attached cushioning members in an open state.
Figure 2:
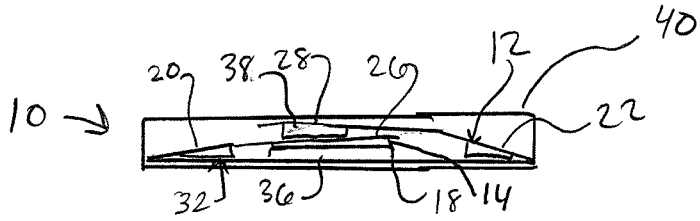
FIG. 2 is a schematic side elevational view of the container of FIG. 1, folded into a compressed state.
Figure 3:
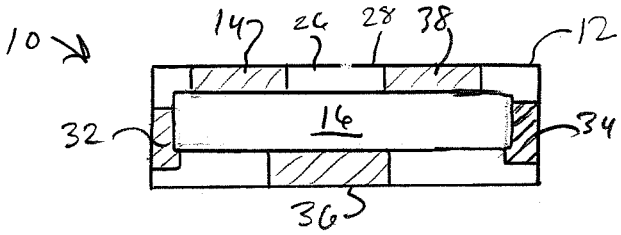
FIG. 3 is a schematic sectional side elevational view of the container of FIG. 1, in an expanded state, closed, and containing an article to be shipped.

With reference to FIGS. 1-3, a compressible shipping container 10 can include an outer portion 12 made from materials that are appropriate for the outer wall of a container that is appropriate for shipping purposes. Additionally, the container 10 can include one or more cushions 14 attached to an inner surface of the outer assembly 12.

The outer assembly 12 can be made from any type of material. Such typical materials can include, but without limitation, paper, cardboard, corrugated cardboard, chipboard, plastic, and other appropriate materials. The material chosen for the outer assembly 12 can be a substantially rigid, but foldable material. It will be appreciated that, although denominated as rigid or substantially rigid, the chosen material would preferable have an amount of flexibility in cases of extreme physical impact, as is well known in the packaging arts. In some embodiments, the outer assembly 12 can be made from one or more pieces of corrugated cardboard. In some embodiments, the material used to form the outer assembly is a single wall, corrugated C-flute cardboard. Other materials and flute sizes can also be used. In some embodiments, the outer assembly 12 can be made from a material having a basis weight of at least about 75 pounds.

In some embodiments, the outer assembly 12 can be formed from a material having any strength, as long as when assembled with an article inside, the combination of the 3 components of the container 10 (the outer assembly 12, the cushions 14 and the article 16) result in a packaging unit able to protect the article from the rigors of commercial shipping, such as with companies including UPS, USPS, FedEx, etc.

The outer assembly 12 can be in the form of any type of configuration of container, such as those containers typically referred to as "boxes." Additionally, the outer assembly 12 can be configured to be foldable between at least two states. Firstly, the outer assembly 12 can be configured to be foldable to an expanded state in which the assembly 12 can be closed to surround or contain an article to be shipped, for example, the article 16 illustrated in FIG. 3. In some applications, the article 16 could be a digital cable box, a laptop computer, a satellite television receiver, etc.

With continued reference to FIG. 1, the assembly 12 can also be configured to be foldable in a compressed state, such as that illustrated in FIG. 2. In FIG. 2, the outer assembly 12 is folded such that the total volume of the outer assembly 12 is smaller than the total volume of the outer assembly 12 illustrated in FIG. 3.

For example, the outer assembly 12 can include a bottom portion 18, a plurality of side walls 20, 22 (only two side walls 20, 22 are shown, but it is to be understood that the assembly 12 can include four side walls). The side walls 20, 22 can all be attached to the bottom 18 so as to form a tray-type configuration, being closed at the bottom 18 and the side walls 20, 22 with an upwardly facing opening 24. Additionally, the container 12 can include lid portions 26, 28, pivotably attached to one or more side walls 20, 22 so as to be movable between an open state (illustrated in FIG. 1) and a closed state (illustrated in FIG. 3).

As noted above, the container 10 can include at least one cushion 14. FIG. 1 illustrates a cushion 14 mounted to an inner surface 30 of the assembly 12, and more particularly, on an inner surface of the lid portion 26. The container 10, in the illustrated embodiment, also includes cushions 32, 34 mounted on the inner surfaces of the side walls 20, 22 and a cushion 36 mounted to an inner surface of the bottom 18. This is merely an example of a configuration of cushions 14 that can be used. Other configurations can also be used.

The cushions 14, 32, 34, 36, 38 can be made from any type of compressible cushion material such as, for example, but without limitation, polyurethane, polyethylene, expanded polypropylene, expanded polystyrene, expanded polyethylene, cross-linked polyethylene, all of which can be fabricated or molded in the desired shapes. Additionally, the cushions can be made from felted polyurethane, thermal-formed plastics, thermal-formed foams, molded air bladders with or without air valves. However, other materials can also be used that can provide a cushion for a packaged item, such as the article 16.

With continued reference to FIG. 1, in the illustrated orientation of the outer assembly 12, the cushions 14, 32, 34, 36, 38, are in a free expanded state and the outer assembly 12 is in an expanded state.

As noted above, and with reference to FIG. 2, the assembly 10 can be configured to be foldable to a compressed state which has a total volume smaller than that occupied by the container in the configuration of FIG. 3. For example, the outer assembly 12 can be configured to be foldable such that the side wall 20 and lid portion 26 can be folded toward the bottom and the side wall 22 and lid portion 28 can be folded on top of the side wall 20 and lid portion 26, and also toward the bottom 18. In such a configuration, the cushions 14, 32, 34, 36, and 38 are compressed as the outer assembly 12 is flattened into the configuration illustrated in FIG. 2.

Being foldable into such a compressed configuration can provide significant advantages. For example, as explained in the Summary of the Invention section, some shipping companies use a "dimensional weight" function for calculating shipping charges. Thus, if the container 10 is folded into the configuration of FIG. 3, and were dimensioned so as to form a container 10 having the dimensions of 19"×16"×5.5", it would occupy a volume of 1,672 cubic inches. Some companies use a dimensional weight function in which the volume of 1,672 cubic inches is divided by a constant of 194 cubic inches per pound. This will result in a "dimensional weight" of 8.62 pounds for the container 10, in the configuration illustrated in FIG. 3.

However, by configuring the container 10 to be foldable into the compressed state illustrated in FIG. 2 where, in some embodiments, the container 10 occupies a space of 19"×16"×1", the resulting total volume occupied by the container 10 would be 304 cubic inches. Dividing this volume 304 inches by the constant 194 cubic inches per pound would result in a dimensional weight of 1.57 pounds. As such, the shipping cost for the container 10 in the configuration of FIG. 2 would be 80% less than the shipping cost of the container 10 in the configuration of FIG. 3.

As such, the container 10 can be shipped to a destination, such as a retail consumer, who needs the package to ship an article 16. The retail user could receive the container 10 in the configuration of FIG. 2, expand the container 10 into the configuration of FIG. 1, add the article 16 through the opening 24, then close the lids 26, 28 so the container is in the configuration of FIG. 3. Then, the end user can ship the article 16 in the container 10, with the cushions 14, 32, 34, 36, 38 supporting and cushioning the article 16.

Optionally, with reference to FIG. 2, an additional securing device 40 can be provided to maintain the container in the compressed configuration of FIG. 2, against any spring effect or bias of the cushions 14, 32, 34, 36, 38. For example, the securing device 40 can be in the form of a plastic strap, staples, string, tape, or sleeve, such as a sleeve made from corrugated cardboard. However, other types of securement devices can also be used.

FIGS. 4-10 illustrate a further embodiment of the container 10 which is identified generally by the reference numeral 100. The container 100 is configured to be foldable between expanded and compressed states, similarly to that of container 10. The description set forth above with regard to the materials and manufacturing techniques of the container 10 apply equally to the container 100.

The container 100 can be formed from one or more pieces of a rigid material so as to form an outer assembly 102 of the container 100. The outer assembly 102 can be formed from any of the materials noted above with regard to the assembly 12, or other materials.

The outer assembly 102 can include a plurality of sections defining different portions of the resulting outer assembly illustrated in FIGS. 5-10. For example, the outer assembly 102 can include end sections 104, 106 and side sections 108 and 110. In the illustrated embodiment, each of the sections 104, 106, 108, 110, include portions for forming parts of a bottom and a top of the container 100. Additionally, the end sections 104, 106 include a portion defining end walls of the container 100. Similarly, the side sections 108, 110 include portions for forming side walls of the container 100.

More specifically, for example, the end sections can include end wall panels 112, 114, bottom panels 116, 118 and lid panels 120, 122 pivotably connected to the lower end upper edges, respectively, of the end wall panels 112, 114. Similarly, the side sections 108, 110 can include side wall panels 124, 126, bottom panels 128, 130 and lid panels 132, 134 pivotably attached to the side walls panels 124, 126, respectively. Optionally, the outer assembly 102 can include a closure tab 136 extending from a side wall portion 110, or another portion of the assembly 102, so as to facilitate fixation of a free edge of the side wall section 110 to a free edge of the end wall section 104, using techniques well known in the art.

Similarly to the container 10, the container 100 can be configured to be foldable between an expanded state and a compressed state. In some embodiments, the assembly 102 can include additional fold lines 140 configured to allow the assembly 102, when in assembled into a box-like configuration, to collapse inwardly during folding of the container 100 from an expanded state to a compressed state.

For example, with reference to the side section 108, the container 100 can include a fold line 142 extending from a lower corner of the side wall panel 124, skewed upwardly and extending onto the top panel 132 to a central area thereof. Additionally, the side section 108 can include a symmetrically arranged fold line 144 extending from the opposite lower corner of the side panel 124 and also extending upwardly towards a central area of the top panel 132. Additionally, the side section 108 can include additional fold lines 146, 148 extending from opposite upper corners of the side panel 124 towards a central area of the top panel 132.

In some embodiments, the top panel 132 can include a U-shaped notch 150 having a bottom or bight section 152 and upwardly extending wings 154, 156. Lower edges of the wings 154, 156 can be spaced apart from each other by the bight section 152. In the illustrated embodiment, the fold lines 142, 146 extend to the left end of the bight 152 and the fold lines 144, 148 extend to the right end of the bight 152. This configuration of fold lines helps facilitate a collapsing, folding movement of the side section 108, which will be described in greater detail below with reference to FIGS. 7-10.

Optionally, the end wall sections 104, 106 can be shaped to further facilitate folding of the container 100 into a collapsed state. For example, the bottom panels 116, 118 can include tapered portions 160, 162. Similarly, the top panels 120, 122 can also include tapered portions 164, 166. The tapered portions 160, 162, 164, 166, can be sized and shaped to provide further clearance during the movement of the container 100 from its expanded state illustrated in FIG. 6 to its compressed state illustrated in FIGS. 9 and 10, described in greater detail below.

Figure 4:
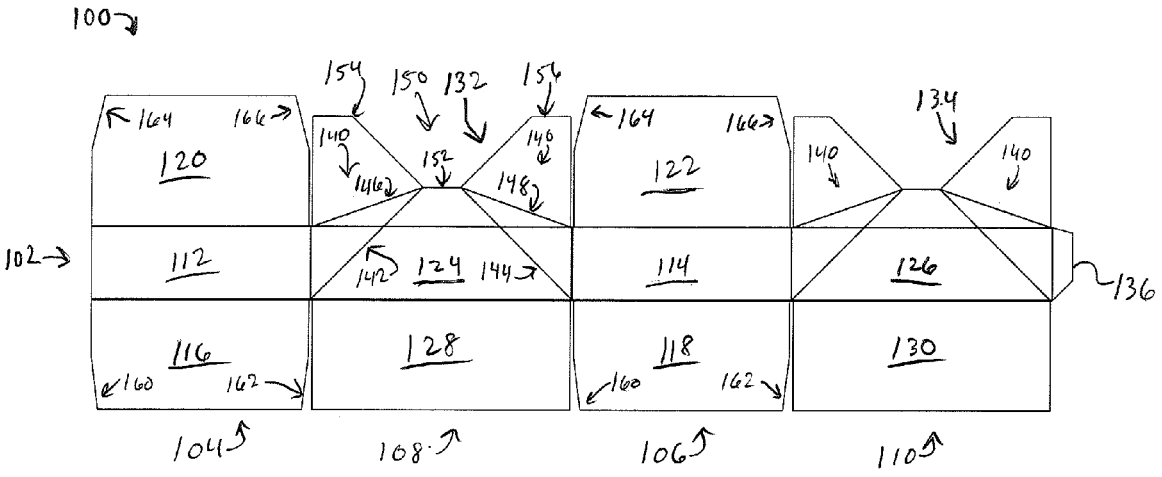
FIG. 4 is a schematic layout of another embodiment of a compressible shipping container.
Figure 5:
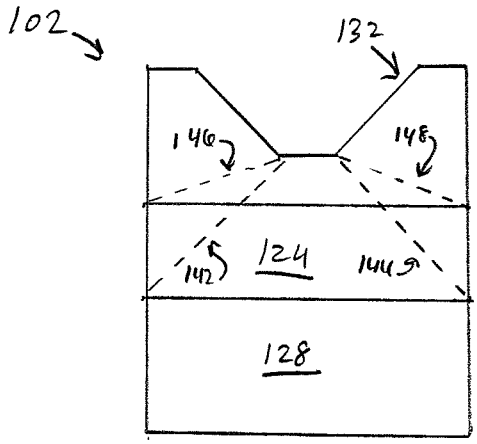
FIG. 5 is a side elevational view of the container of FIG. 4, partially folded into an expanded state.

With continued reference to FIGS. 4 and 5, the assembly 102 can be folded along the fold lines between the end sections 104, 106 and the side sections 108, 110 with the tab portion 136 fixed to the free end of the side panel 112, so as to form a circumferentially closed shape, a side elevational view of which is illustrated in FIG. 5. In FIG. 5, the bottom panels 116, 128, 118 and 130, are not folded, and are extending downwardly, thereby leaving the assembly 102 in a tube-like configuration.

Figure 6:
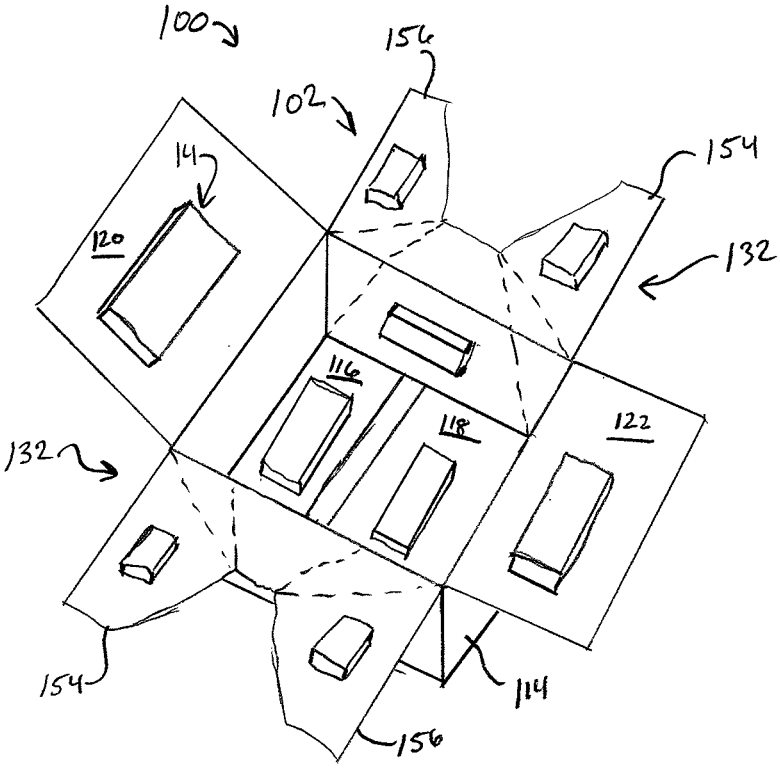
FIG. 6 is a perspective view of the container of FIG. 5, including an example of a layout of cushioning materials attached to various parts thereof.

With reference to FIG. 6, the bottom panels 116, 118, 128, 130 have been folded upwardly so as to close the bottom of the container 100.

With continued reference to FIG. 6, the container 100 can include at least one or more cushions 14. In some embodiments, the cushions 14 can be securely attached to various components of the outer assembly 102. Optionally, one or more cushions 14 can be simply placed inside the open cavity of the container 102 without being adhered or connected to the inner surfaces of the various portions of the assembly 102. For example, in some embodiments, although not illustrated, the container 100 can include four pieces, approximately the same size as the side and end panels 112, 114, 124, 126, as well as a cushion that is approximately the size of the bottom formed by the bottom panels, 116, 118, 128, 130. Additionally, a further top cushion can be included which can be approximately the same size or smaller than the bottom portion noted above. The cushions included, such as the cushion 14, can be made from any of the materials noted above, or other materials.

Figure 7:
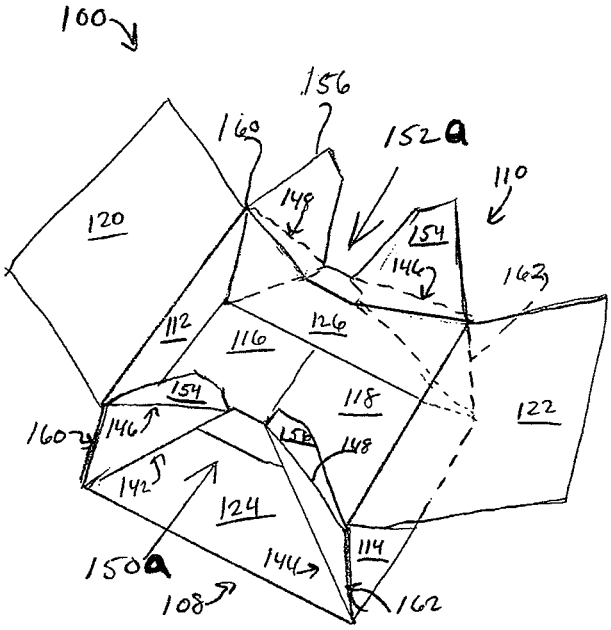
FIG. 7 is a perspective view of the container of FIG. 6, in an intermediate step in the process of compressing the container into a compressed state and with the cushioning material removed.

With reference to FIG. 7, as noted above, the fold lines 142, 144, 146, 148 can be configured to allow the side sections 108, 110 to be collapsed inwardly toward the inner cavity of the container 100. For example, if a force is applied in the direction of the arrows 150*a*, 152*a*, central portions of the side panels 124, 126 can fold inwardly and thus pivot and rotate toward the bottom of the container 100 formed by the bottom panels 116, 118, 128, 130. This movement also causes the end panels 112, 114 to also fold downwardly towards the bottom of the container 100. This movement is similar to the movement of leaves of a blossoming flower or the wings of a bird when a bird moves its wings from an outstretched position to a swept back position.

Additionally, the lateral end portions of the side panels 124, 126 simultaneously pivot along the fold lines 142, 144 and the lateral ends 160, 162 of the side panels 124, 126 where they are attached to the end walls 112, 114. Additionally, the wing portions 154, 156 pivot along the fold lines 146, 148 away from the bottom of the container 100 toward the position illustrated in FIG. 8 (a top plan view). The top panels 120, 122 have been removed from the top plan view of FIG. 8 so as to provide a more clear view of the folding action of the side sections 108, 110.

Figure 8:
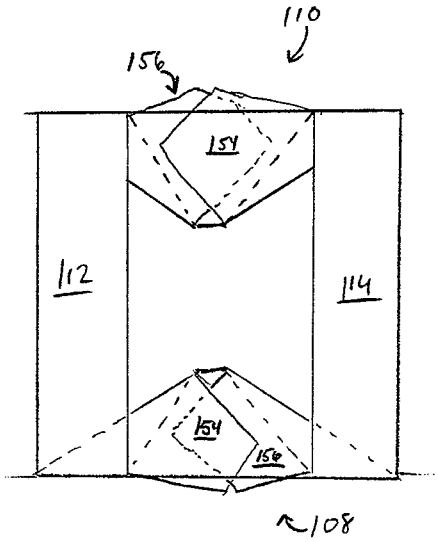
FIG. 8 is a top plan view of the container of FIG. 7, in a further state towards the compressed state.

With continued reference to FIG. 8, the continued movement of those described above with reference to FIG. 7, the wings 154, 156 can be folded on top of each other as the side panels 124, 126 are further moved towards one another. Eventually, as the panels 124, 126 are continued to be folded inwardly, the wings 154, 156 can be folded such that they are contained completely within the footprint of the bottom of the container 100.

Figure 9:
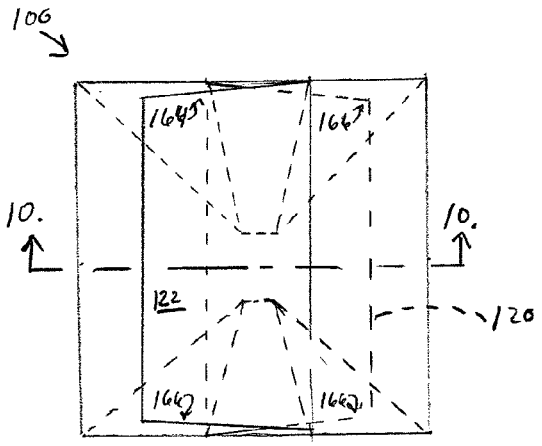
FIG. 9 is a top plan view of the container of FIG. 6, in a fully compressed state.

For example, as shown in FIG. 9, the side panels 124, 126 have been fully folded inwardly and the entirety of the side panels 124, 126 and wings 154, 156 are entirely disposed within the footprint defined by the bottom of the container 100. Additionally, the lid panels 120, 122 can be folded on top of one another, with the tapered portions 164, 166 providing for additional clearance allowing the top panels to be folded one on top of the other.

Figure 10:
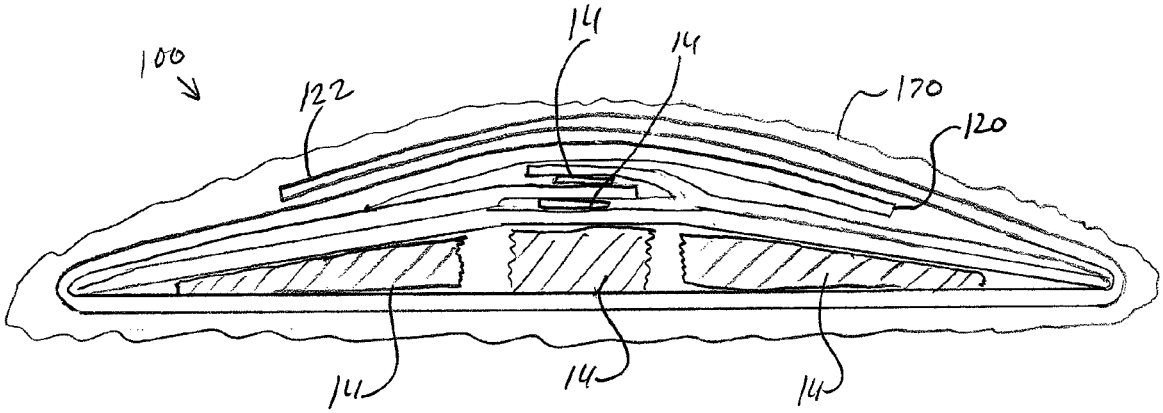
FIG. 10 is a sectional view taken along the line 10-10 of FIG. 9, with the container in a fully compressed state and within a retention member.
Figure 12:
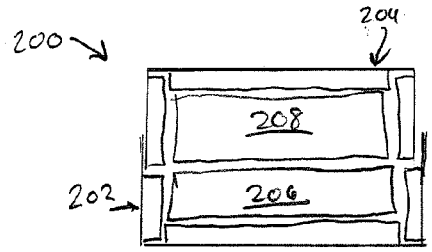
FIG. 12 is a schematic side elevational and sectional view of the container of FIG. 11, with one portion nested into the other.

With reference to FIG. 10, which is a cross-sectional view of the container 100 taken along line 10-10 of FIG. 9, the various panels and portions of the container 100 have been folded one on top of another so as to convert the container and the outer assembly 102 into a compressed configuration, illustrated in FIG. 10, in which the cushions 14 are also compressed from their free expanded state.

As a dimensional example, if the container 100, in the configuration illustrated in FIG. 6, were closed with the top panels 120, 122, 132, 134 folded inwardly so as to form a cubic container, in some embodiments, it can have the dimensions of 19"×16"×5.5". Similarly to the embodiment to the container 10 described above, in the compressed configuration illustrated in FIGS. 9 and 10, the container 100 can have approximate dimensions of 19"×16"×1". As such, the total volume occupied by the container is reduced by approximately 80%.

Optionally, the container 100 can be secured into the fully compressed orientation illustrated in FIGS. 9 and 10 with a securement device 170. The securement device 170 can be the same or similar to the securement device 40 noted above. In some embodiments, the securement device 170 can be the type of device which is acceptable to have on the outside of a container for shipping through commercial shipping providers. Thus, the securement device 170 can be a sleeve made out of corrugated cardboard, a strap, a string, tape, etc. In some embodiments, the securement device 170 can be a plastic envelope and vacuum sealed so as to provide additional compressive force.

With reference to FIGS. 11-16, a further embodiment of the containers 10, 100 is illustrated therein and identified by the reference numeral 200. The descriptions set forth above with regard to the containers 10 and 100 with regard to the materials used therefore also apply to the container 200.

The container 200, in some embodiments, can be formed from two nesting portions 202, 204. The nesting portions 202, 204 can have any shape, and in some embodiments, can each form an open trough-type shape. Additionally, similar to the containers 10 and 100, the outer surfaces or walls of the nesting portions 202, 204 can be made from any of those materials that are appropriate for forming containers shipped through commercial shipping providers—for example, single-layer C-flute corrugated cardboard. Other materials can also be used.

The nesting portions 202, 204 can include an arrangement of cushions 206, 208 disposed therein. In some embodiments, optionally, the cushions 206, 208 can be fixed to the inner surfaces of the nesting portions 202, 204. The cushions 206, 208 can be made from any of the materials noted above with regarding to the cushions 14. Other materials can also be used.

Figure 11:
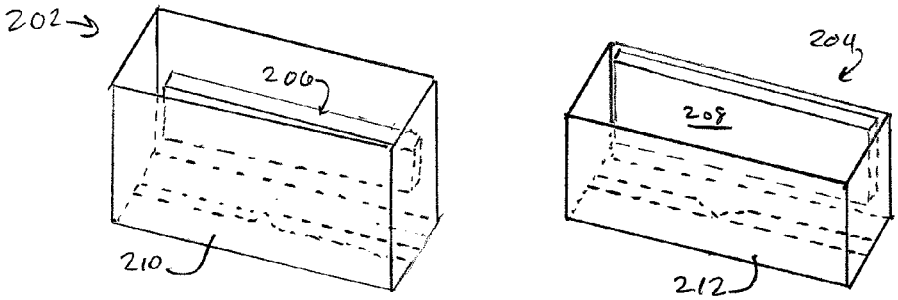
FIG. 11 is an exploded perspective view of a compressible shipping container having two portions that are nestable with each other.

As shown in FIG. 11, the cushion 208 can extend substantially along the entire height of the nesting portion 204. In contrast, the cushion 206 can extend only partly up the height of the nesting portion 202. Additionally, the outer dimensions of the nesting portion 204 can be slightly smaller than that of the outer dimensions of the nesting portion 202. As such, the nesting portion 204 can be nested into the nesting portion 202 into the configuration illustrated in FIG. 12 so as to form a closed shipping container appropriate for shipping an article. The reduced height of the cushion 206 compared to the height of the cushion 208 provides clearance for the nesting of the nesting portion 208 to be inserted into the portion 202.

Figure 13:
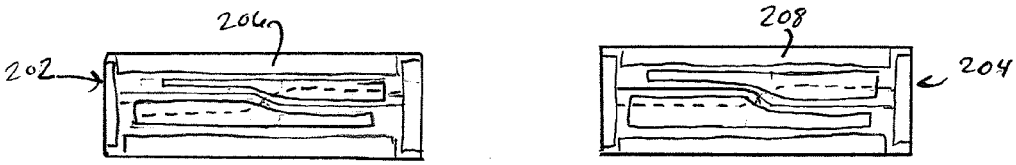
FIG. 13 is a top plan view of the two portions of the container of FIG. 11.

FIG. 13 illustrates side-by-side top plan views of the nesting portions 202, 204. As illustrated, the bottoms 210, 212 of each of the nesting portions 202, 204 include a split overlapping configuration which allows the bottoms 210, 212 to be moved between opened and closed states. This type of configuration is well known in the corrugated cardboard industry as both an "auto bottom box (or tray)" and a "snap lock bottom box (or tray)".

Figure 14:
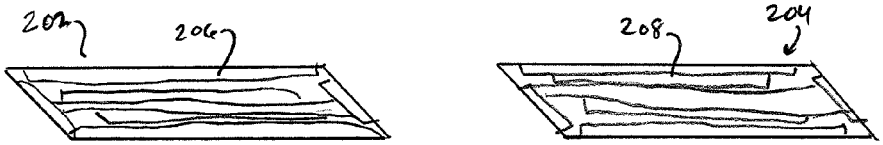
FIG. 14 is a top plan view of the two portions illustrated in FIG. 13, being shifted into a racked position.
Figure 15:
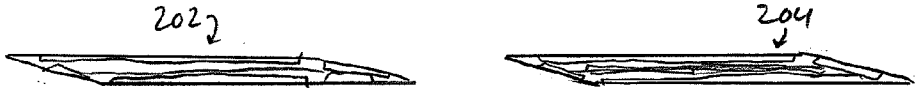
FIG. 15 is a further top plan view of the two portions of the container illustrated in FIG. 14, being further racked into a folded and compressed state.

Additionally, the split configuration of the bottoms 210, 212 allow the nesting portions 204, 206 to be "racked", as illustrated in FIGS. 14 and 15. This racking movement of the nesting portions 204, 206 allows the nesting portions 204, 206 to be moved between the expanded state, illustrated in FIGS. 11 and 12, and a compressed state, illustrated in FIGS.

15 and 16. In the compressed states of FIGS. 15 and 16, the nesting portions 202, 204 have been racked until the cushions 206, 208, as well as any other cushions that may be included on the bottoms 210, 212, are compressed. Additionally, the split configuration of the bottoms 210, 212 allow the bottom panels to fold upwardly and into the interior of the nesting portions 202, 204 so as to fold up against the side walls of the nesting portions 202, 204. As such, the bottoms 210, 212 of each of the nesting portions 204, 206 generally fold such so that they lie parallel to the side walls of the nesting portions 202, 204. Further, the cushions 206, 208 are compressed. This provides the advantage of reducing the overall volume of the container 200 as compared to the configuration illustrated in FIGS. 11 and 12.

Figure 16:
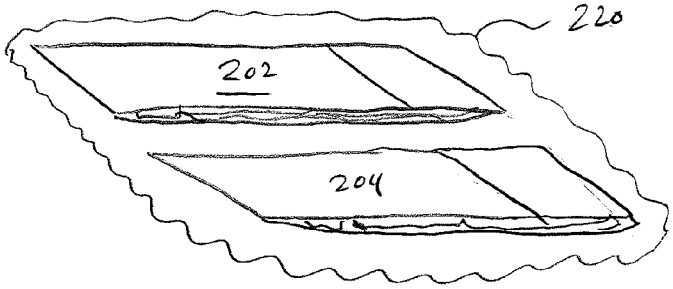
FIG. 16 is a perspective view of the two portions illustrated in FIG. 15, and packaged together.

With reference to FIG. 16, the nesting portions 202, 204, in their compressed states, can be packaged together with a packaging member 220 designed to retain the nesting portions 202, 204 in their compressed state and so that they can be shipped or transported together in a single package. For example, the member 220 can be in the form of a sleeve of corrugated cardboard, a strap, a string, tape, or a plastic envelope used for vacuum packaging.

Figure 17:
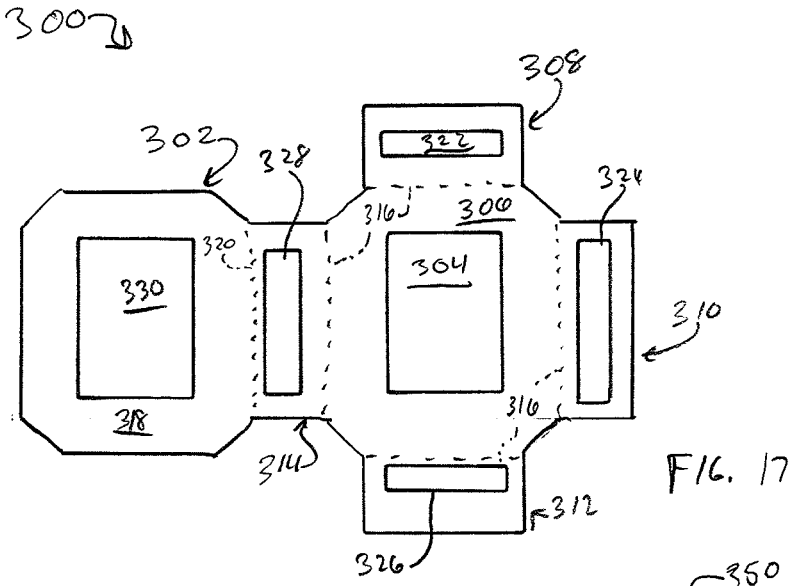
FIG. 17 is a plan view of another embodiment of a compressible shipping container having cushion materials attached thereto.

FIGS. 17-20 illustrate yet another embodiment of a compressible packaging assembly. As shown in FIG. 17, the packaging assembly 300 can include a base member 302 divided into various panels and one or more cushions 304. The base member 302 can be in the form of a rigid frame member made from materials such as those used for the assemblies 12, 102 noted above, or other flexible materials such as flexible plastic skins. For example, in some embodiments, the entire packaging assembly 300 can be made entirely from cushion material, either molded or fabricated. Additionally, regardless of whether it is made from molded or fabricated cushion materials, one or more flexible skins can be attached to one or more surfaces of the cushion materials or the base member 302. Such a skin can help in folding and can also add strength or rigidity to the packaging assembly 300.

In the illustrated embodiment, the base member 302 is formed into a plurality of panels including a bottom panel 306, a plurality of side panels 308, 310, 312, 314, all of which are attached to the bottom portion 306 along fold lines 316. Additionally, the base member 302 includes a top panel 318 attached to the side panel 314 along a fold line 320.

In some embodiments, the base member 302 also includes at least one cushion member 304. The cushion 304 can be in the form of any of the cushions noted above, such as the cushion 14. In some embodiments, the packaging assembly 300 includes a cushion for each of the panels of the base member 302. In the illustrated embodiment, the packaging assembly 300 includes cushions 322, 324, 326, 328, 330.

In this configuration, the packaging assembly 300 can be inserted into a generic box 332 so as to provide cushioning on the bottom, top, and all side walls for an article to be placed therein.

Figure 18:
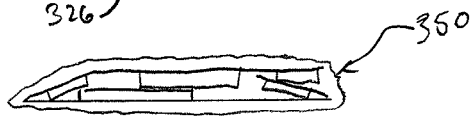
FIG. 18 is a schematic side elevational view of the container of FIG. 17, folded into a compressed state.
Figure 19:
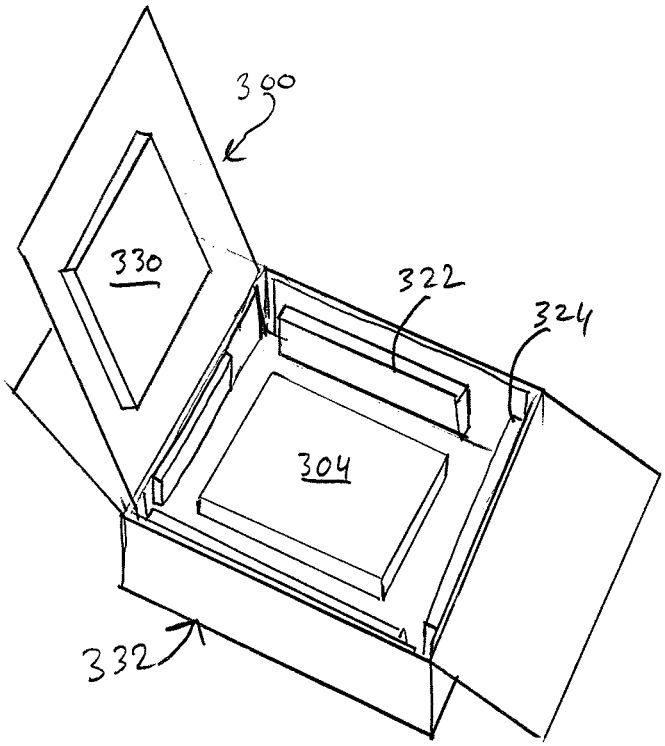
FIG. 19 is a perspective view of the container of FIG. 17, inserted into another box in an open state.

Additionally, with reference to FIG. 18, the packaging assembly 300 can be folded into a compressed state. For example, the panels 308, 310, 312, 314 can all be folded inwardly over the bottom panel 306. Additionally, the top panel 318 can also be folded over the bottom panel 306 so as to compress the various cushions 304, 322, 324, 326, 328, 330, as illustrated in FIG. 18. This can provide the advantage of providing a compact configuration such that the packaging assembly 300 can be shipped at a reduced shipping rate where the dimensional weight function described above provides a reduced shipping cost. In some embodiments, the packaging assembly 300 can be contained within a securement device 350 so as to retain the packaging assembly 300 into its compressed configuration, illustrated in FIG. 18. For example, in some embodiments, the containment device 350 can be a cardboard sleeve, a string, a strap, staples, tape, or an envelope for vacuum sealing.

Figure 20:
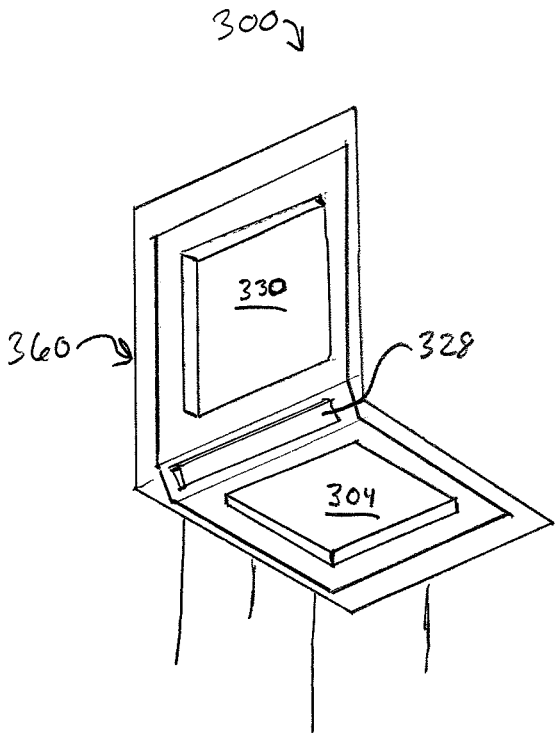
FIG. 20 is an illustration of a modification of the embodiment of FIGS. 17-19, with certain portions removed and converted into a seat cushion.

With reference to FIG. 20, the packaging assembly 300 can also be repurposed for other uses. For example, as shown in FIG. 20, the insert 300 has been modified such that the panels 308, 310, 312 have been cut off along the fold lines 316. As such, the packaging assembly 300 becomes generally the configuration of a seat pad that can be placed on a chair 360 and thereby provide cushioning for a user of the chair 360.

Although the present inventions have been described in terms of certain embodiments, other embodiments apparent to those of ordinary skill in the art also are within the scope of these inventions. Thus, various changes and modifications may be made without departing from the spirit and scope of the inventions. For instance, various components may be repositioned as desired. Moreover, not all of the features, aspects and advantages are necessarily required to practice the present inventions.

What is claimed is:

1. A shipping container for containing and protecting an article during transport, comprising:

at least one cushion;

an outer container comprising at least a bottom wall that is planar, the at least one cushion being disposed in the outer container, the outer container being foldable between at least first and second states, wherein when in the first state, the outer container forms a closed shipping container sized to encompass a first volume of space sufficient to enclose an article and cushion the article with the at least one cushion, and wherein in the second state, the outer container is folded into a compressed state occupying a second volume, smaller than the first volume, with the at least one cushion member compressed within the outer container and with the bottom wall in a planar state;

a first sidewall portion and a second sidewall portion pivotably connected to the bottom wall at a fold and disposed on opposite sides of the bottom wall; and a third sidewall portion and a fourth sidewall pivotably portion connected to the bottom wall and disposed on opposite sides of the bottom wall;

wherein when the outer container is transitioned from the first state to the compressed state the first and second sidewall portions are configured to fold towards the bottom wall and the third and fourth sidewall portions are configured to fold over the first and second sidewall portions.

2. The shipping container according to claim 1 additionally comprising a securement device configured to retain the outer container in the compressed state against a bias of the compressed cushion.

3. The shipping container according to claim 1, wherein the outer container comprises at least a first portion that is configured to move from the first state to the second state with a racking motion.

4. The shipping container according to claim 1, wherein the outer container comprises first and second separate nesting portions.

5. The shipping container according to claim 1 wherein at least the first and second sidewall portions comprise a sidewall panel including upper and lower edges and left and right lateral edges, and at least one fold line extending across the sidewall panel and along a direction skewed relative to the upper and lower edges and the left and right lateral edges.

6. The shipping container according to claim 5, wherein the outer container further comprises at least one top panel portion pivotably attached to the upper edge of the first sidewall portion, the top panel portion having a U-shape.

7. The shipping container according to claim 6, wherein the at least one top panel portion includes at least first and second wing portions defining the U-shape.

8. The shipping container for containing and protecting an article during transport according to claim 1, wherein the bottom wall of the outer container is in a planar state when the shipping container is in the first state.

9. A shipping container for containing and protecting an article during transport, comprising:

at least one cushion;

an outer container comprising at least a bottom wall that is planar, the at least one cushion being disposed in the outer container, the outer container being foldable between at least first and second states, wherein when in the first state, the outer container forms a closed shipping container sized to encompass a first volume of space sufficient to enclose an article and cushion the article with the at least one cushion, and wherein in the second state, the outer container is folded into a compressed state occupying a second volume, smaller than the first volume, with the at least one cushion member compressed within the outer container and with the bottom wall in a planar state;

wherein the outer container further comprises at least first, second, third, and fourth sidewall portions connected to the bottom wall wherein at least the first and second sidewall portions comprise a sidewall panel including upper and lower edges and left and right lateral edges, and at least one fold line extending across the sidewall panel and along a direction skewed relative to the upper and lower edges and the left and right lateral edges;

wherein the outer container further comprises at least one top panel portion pivotably attached to the upper edge of the first sidewall portion, the top panel portion having a U-shape;

wherein the at least one top panel portion includes at least first and second wing portions defining the U-shape; and wherein a bight portion of the U-shaped top panel portion is disposed between the first and second wing portions, and wherein the at least one fold line extends to the bight portion.

10. A shipping container configured for containing and protecting an article during transportation, comprising:

an outer container assembly comprising one or more pieces of planar substrate material defining at least a bottom wall that is planar and a first sidewall and a second side wall connected to the bottom wall, the one or more pieces of planar substrate material being foldable between a first collapsed configuration in which the planar bottom and the plurality of sidewalls at least partially surround a first volume and a second deployed configuration in which the bottom wall is planar, and the bottom wall and the plurality of sidewalls at least partially surround a second volume that is larger than the first volume;

the first side wall including upper and lower edges and left and right lateral edges, and a first fold line extending from the lower edge to the upper edge in a straight line and along a first direction skewed relative to the upper and lower edges and the left and right lateral edges;

at least a first compressible cushion member comprising a compressible material, the first compressible cushion member being disposed within the outer container assembly, the first compressible cushion member having a size such that the first compressible cushion member is pressed into a compressed state when the one or more pieces of planar substrate material are in the first collapsed configuration and wherein the first compressible cushion member is expanded to an expanded state in which the first compressible cushion member is larger than when in the compressed state.

11. The shipping container according to claim 10, wherein the one or more pieces of planar substrate material are configured to form a complete outer container appropriate for shipping when the outer container assembly is in the compressed state and when in the deployed configuration.

12. The shipping container according to claim 10, wherein the one or more pieces of planar substrate material for a generally rectangular box.

13. The shipping container according to claim 10 additionally comprising a retention member configured to retain the outer container assembly in the compressed state against a bias of the first cushion member.

14. The shipping container according to claim 10, wherein the first volume is about twenty percent of the second volume.

15. The shipping container configured for containing and protecting an article during transport according to claim 10, further comprising a top portion pivotably connected to the upper edge, the top portion comprising first and second wing portions defining a bight section, the fold line extending to the bight section.

16. The shipping container configured for containing and protecting an article during transport according to claim 10 further comprising: a second fold line extending from the lower edge to the upper edge in a second straight line and along a second direction skewed relative to the upper and lower edges and the left and right lateral edges.

17. A shipping container for containing and protecting an article during transport, comprising:

at least one cushion; and an outer container, the at least one cushion being disposed in the outer container, the outer container being foldable between at least first and second states, wherein when in the first state, the outer container forms a closed shipping container sized to encompass a first volume of space sufficient to enclose an article and cushion the article with the at least one cushion, and wherein in the second state, the outer container is folded into a compressed state occupying a second volume, smaller than the first volume, with the at least one cushion member compressed within the outer container;

wherein the outer container portion comprises at least a bottom wall and at least first, second, third, and fourth sidewall portions connected to the bottom wall, wherein at least the first and second sidewall portions comprise a sidewall panel including upper and lower edges and left and right lateral edges, and at least one fold line extending across the sidewall panel and along a direction skewed relative to the upper and lower edges and the left and right lateral edges; and wherein the outer container further comprises at least one top panel portion pivotably attached to the upper edge of the first sidewall portion, the top panel portion having at least first and second wing portions defining a U-shape, wherein a bight portion of the U-shaped top panel portion is disposed between the first and second wing portions, and wherein the at least one fold line extends to the bight portion.

* * * * *